US006092467A

United States Patent [19]

Brice

[11] Patent Number: 6,092,467

[45] Date of Patent: Jul. 25, 2000

[54] FLARE APPARATUS

[75] Inventor: William F. Brice, Lakewood, Calif.

[73] Assignee: Skyblazer, Inc., Fullerton, Calif.

[21] Appl. No.: 09/013,730

[22] Filed: Jan. 27, 1998

Related U.S. Application Data

[60] Provisional application No. 60/059,489, Sep. 22, 1997.

[51] Int. Cl.[7] ..... F42B 4/12

[52] U.S. Cl. ..... 102/336

[58] Field of Search ..... 102/336, 346, 102/340, 342

[56] References Cited

U.S. PATENT DOCUMENTS

| | | | |
|---|---|---|---|
| Re. 8,167 | 4/1878 | Very | 102/342 |
| 190,263 | 5/1877 | Very | 102/346 |
| 217,115 | 7/1879 | Kendall | 102/346 |
| 231,705 | 8/1880 | Faure et al. | 102/346 |
| 630,477 | 8/1899 | Behr | 102/346 |
| 784,977 | 3/1905 | Bowly | 102/336 X |
| 2,459,687 | 1/1949 | Decker | 102/37.7 |
| 3,062,144 | 11/1962 | Hori et al. | 102/38 |
| 3,349,707 | 10/1967 | Wortley, Jr. et al. | 102/37.6 |
| 3,485,169 | 12/1969 | Lai | 102/336 |
| 3,611,935 | 10/1971 | Beckes et al. | 102/37.7 |
| 3,749,019 | 7/1973 | Hancock et al. | 102/34.4 |
| 3,759,216 | 9/1973 | Sanders | 116/124 B |
| 3,855,930 | 12/1974 | Mulich et al. | 102/342 |
| 5,390,605 | 2/1995 | Meili et al. | 102/336 |
| 5,631,441 | 5/1997 | Briere et al. | 102/336 |

*Primary Examiner*—Charles T. Jordan
*Assistant Examiner*—Denise J. Buckby
*Attorney, Agent, or Firm*—Stout, Uxa, Buyan & Mullins, LLP; Frank J. Uxa

[57] ABSTRACT

A flare apparatus including a shell base, an explosive assembly carried by the shell base, a flare cover interference fit onto the shell base and having a closed end surface away from the shell base which is convex, a flare composition located in the interior space defined by the flare cover and a fire composition on or in proximity to the flare composition. The present flares are straight forward in construction, easy and inexpensive to produce and provide substantial benefits, for example, attaining higher altitudes when used.

20 Claims, 1 Drawing Sheet

FLARE APPARATUS

CROSS REFERENCE TO RELATED APPLICATION

This application claims the benefit of U.S. Provisional Application No. 60/059,489, filed Sep. 22, 1997, and entitled Flare Apparatus.

BACKGROUND OF THE INVENTION

The present invention relates to flare apparatus. More particularly, the invention relates to such apparatus to provide a signal, for example, in the form of a 12-gauge flare.

Flares are well known as signaling devices, for example, to warn of distress in an emergency, to signal one's location, to provide a specific, e.g., color coded, message and the like. One common flare device is known as a 12-gauge flare, because it resembles a 12-gauge shot gun shell in appearance. Such conventional flares include a so-called flare cup or cover which contains the propellant/signal creating chemicals. The flare cups of these conventional flare devices have a flat closed end. Also, the cup is wrapped or adhered to the shell casing. Thus, when the flare is activated, the flare cup separates from the shell casing and the flare cup and chemicals are propelled into the air where the appropriate signal is given.

Such prior flare devices have a number of draw backs. For example, they tend to be relatively difficult and expensive to produce and to have relatively widely varying, e.g., unconsistent, performance characteristics. In addition, such flares often do not achieve the height or altitude desired. The signal provided by a flare of this type can be seen from a further distance if it achieves a greater altitude.

There continues to be a need to provide new flares.

SUMMARY OF THE INVENTION

New flare apparatus have been discovered. The present apparatus address one or more of the problems with prior flares, noted above. The present flare apparatus are structured to be cost effective to produce and result in performance benefits, e.g. increased consistency or reproducibility in use from one flare to another, and/or achieve higher altitude upon activation, relative to prior flares. Moreover, the present flares are very straightforward in construction, which reduces manufacturing costs and increases ease of manufacturing. In short, the flare apparatus of the present invention provide one or more substantial advantages relative to prior flares.

In general, the present flare apparatus comprise a shell base, an explosive assembly, a flare cover, a flare composition, and a fire composition. The shell base has a peripheral outer surface, a first end and a opposing second end which is open. The shell base defines an interior chamber which is open at the second end. The explosive assembly is carried by the shell base at or near the first end and is located and adapted, upon activation, to cause gas to pass into the interior chamber. In one particularly useful embodiment, the explosive assembly includes a shell shock primer.

The flare cover is interference fit or friction fit onto the peripheral outer surface of the shell base. The flare cover extends away from the first end of the shell base. Having the flare cover simply interference or friction fit onto the shell base provides a very convenient and straightforward approach to coupling these two components. Moreover, no adhesives or wrappings are required. Further, the interference or friction fit allows the flare cover to be separated from the shell base very effectively and consistently, from flare to flare, using the explosive assembly, as described hereinafter.

In one embodiment, the flare cover defines an interior space and a closed end surface, which is preferably convex, located opposite the first end of the shell base. Having a convex closed end surface on the flare cover improves the aerodynamic properties of the flare projectile, that is the flare cover or cup and its contents after the flare cover has separated from the shell base. Ultimately, such convex closed end surface, alone and/or in combination with one or more other features of the present flare apparatus, provide an enhanced ability of the present flare apparatus to achieve higher altitudes relative to prior art flares of a similar type, for example, which include flare covers with flat end surfaces.

The flare composition is located in the interior space of the flare cover, and preferably comprises magnesium. The flare composition is effective, when ignited, to provide a visual indication from the projectile including at least a portion of the flare cover. The fire composition, which preferably comprises gun powder and magnesium, is situated on or in proximity to the flare composition. The fire composition is effective, when ignited, to propel the flare cup away from the shell base and to ignite the flare composition.

Preferably, the present flare apparatus include shell bases which are made of polymeric material, and/or flare covers made of aluminum. Of course, it should be understood that other suitable materials of construction for both the shell base and flare cup can be employed.

In a particularly useful embodiment, the interior chamber of the shell base has a truncated "V"-shape in axial cross-section. Put another way, the interior chamber has a truncated conical configuration. This shape has been found to very effectively provide for the separation of the flare cover from the shell base upon activation of the explosive assembly. This is particularly true when the flare cover is interference or friction fit onto the peripheral outer surface of the shell base.

In one embodiment, the peripheral outer surface of the shell base includes a first portion near the first end of the shell base and a second portion near the second end of the shell base. The first portion defines a larger cross-section than the second portion, and the flare cover is interference or friction fit onto the second portion of the outer peripheral surface. This feature of the present invention is very effective during flare manufacturing to control or maintain the extent to which the flare cover is placed on or receives the shell base. This provides for consistent performance, flare to flare, and in addition controls the amount of force required to separate the shell base from the flare cover upon activation of the explosive assembly. The flare cover preferably includes an outer sidewall configured as a right circular cylinder. This configuration provides for ease of manufacturing and enhances the aerodynamic properties of the flare projectile.

The flare composition preferably includes a curved surface facing the interior chamber, more preferably a surface which is convex relative to the interior chamber, of the shell base. Such curved, and preferably convex, surface provides an increased surface area for ignition of the flare composition. Such increased surface area provides for a more rapid ignition of the flare composition which results in a more timely signal being provided by the flare apparatus and, in addition, may enhance the achieving of higher altitudes.

Each and every combination of one or more features described herein is included within the scope of the present invention, provided that such features are not mutually inconsistent.

These and other advantages of the present invention are apparent in the following detailed description and claims, particularly when considered in conjunction with the accompanying drawings in which like parts bear like reference numerals.

DETAILED DESCRIPTION OF THE PREFERRED EMBODIMENT

Figure 1:
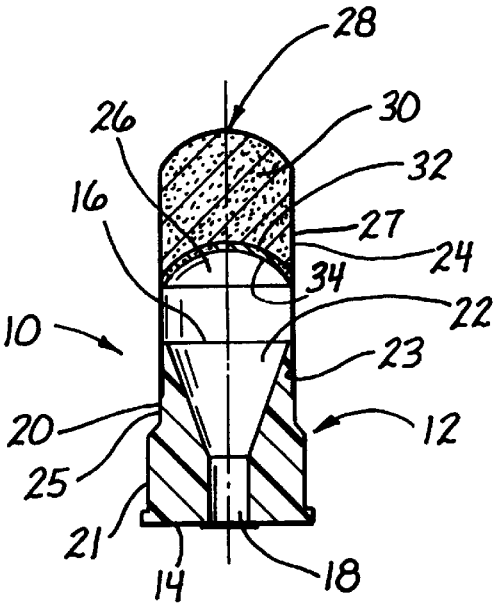
FIG. 1 is a cross-sectional view of a 12-gauge flare shell in accordance with the present invention.
Figure 2:
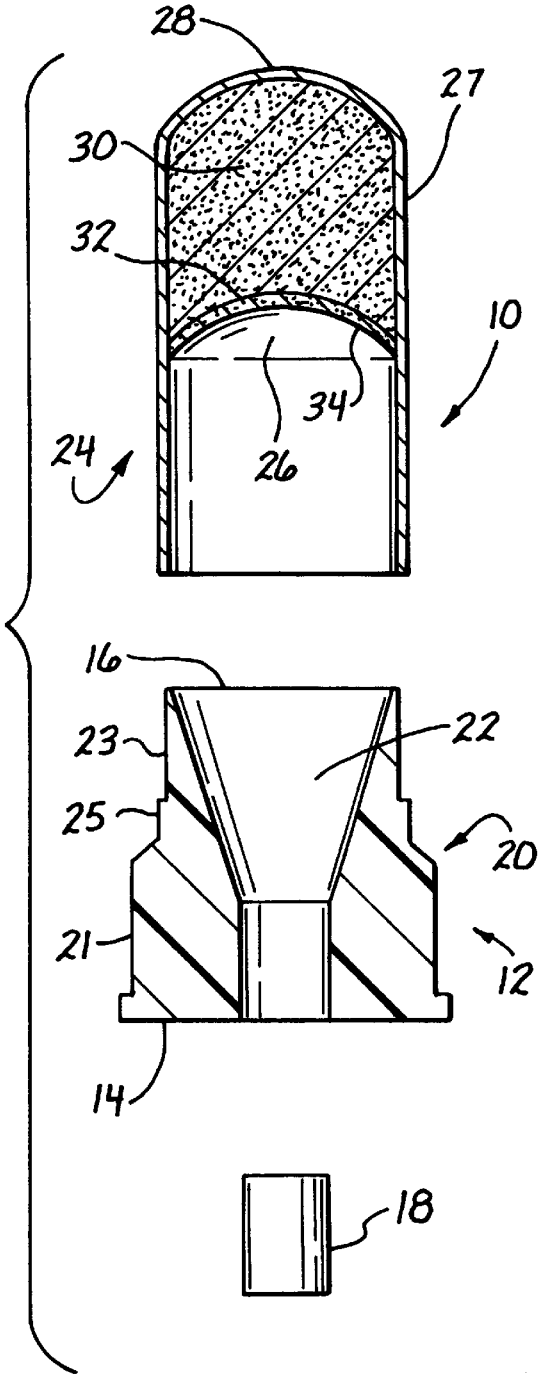
FIG. 2 is an exploded view in cross-section of the 12-gauge flare shell of FIG. 1.

Referring now to FIGS. 1 and 2, a flare apparatus in accordance with the present invention, shown generally at 10, includes a shell base 12, preferably made of substantially rigid polymeric material. Shell base 12 includes a generally circular first end 14 and an opposing, generally circular, second end 16 which is open. A conventional 209 shot shell primer 18 is situated in the shell base 12 such that the primer is exposed at the first end of the shell base.

The shell base 12 includes a generally circular cylindrical exterior peripheral surface 20 and a truncated V-shaped or tapered interior chamber 22 which has a truncated conical configuration and a truncated "V"-shape in cross-section. The surface 20 has a first portion 21 near the first end 14 and second portion 23 near the second end 16. Second portion 23 defines a smaller cross-section than the first portion 21. An intermediate portion 25 of surface 20 is located between first portion 21 and second portion 23 and defines a cross-section which is smaller than that defined by the first portion and larger than that defined by the second portion.

An aluminum flare cup or cover 24 is interference or friction fit onto the second portion 23 of peripheral surface 20 of shell base 12, abuts the intermediate portion 25 of this peripheral surface and extends outwardly from the shell base. The flare cup 24 has a generally circular cylindrical peripheral surface 27, includes an interior space 26 and a closed end surface 28 which is curved, in particular, convex, and is located opposite the first end 14 of the shell base 12.

A flare mix or composition 30 is located in the upper portion of the interior space 26 of the flare cup 24, in particular, near the curved end surface 28 of the flare cup. This flare composition 30 includes magnesium, as well as other conventional additives, such as accelerants, colorants and the like. A layer of fire mix or composition 32 is located on to the flare composition 30 and includes a curved surface 34 which faces the interior chamber 22 of the shell base 12. Curved surface 34 is convex relative to interior chamber 22. This fire mix 32 includes gun powder and magnesium. The flare composition 30 and fire mix 32 can be of conventional and well known chemical make-ups.

The flare shell 10 can be produced using conventional manufacturing and assembly techniques, for example, polymer molding for the shell base 12, metal shaping for the flare cup 24, filling and coating and/or pressing for the flare composition 30 and fire mix 32.

The following procedure may be employed to produce 12-gauge flares in accordance with the present invention. This procedure is used to produce a batch of about 4,000 flares. However, the amounts of each material shown are the amounts per individual 12-gauge flare.

Magnesium particles are doped with cellulose nitrate. Two types of magnesium particles are employed. The first particles, sized at 50/100 mesh, are coated with cellulose nitrate by combining the magnesium particles with a solution including cellulose nitrate and acetone. The mixture is tumbled for a period of time and the acetone is evaporated. 1.3 grams of the doped 50/100 mesh magnesium particles is used in the flare composition per flare.

Similarly, magnesium particles sized at 100/200 mesh are coated with cellulose nitrate. 0.57 grams of the doped 100/200 mesh magnesium particles is used per flare.

These two differently sized doped magnesium particles are combined with 1.27 grams of strontium nitrate, 0.5 grams of a polyvinyl chloride-based binder, 1.9 grams of a conventional oxidizer, such as that sold by Pearson Sales under the trade name Dextrin grade 1751-S, and 0.32 grams of potassium perchlorate. This combination of materials is blended to provide a uniform flare composition.

The fire mix is produced by combining 0.22 grams of the cellulose nitrate doped 100/200 mesh magnesium particles with 0.17 grams of strontium nitrate, 0.07 grams of the polyvinyl chloride-based binder, 0.025 grams of the conventional oxidizer, 0.025 grams of potassium perchlorate, and 0.18 grams of 4 F black powder. These materials are mixed together to form a uniform fire mix.

The individual 12-gauge flares are produced by placing the appropriate amount of the flare composition into the closed end of the aluminum cup 24. The appropriate amount of the fire mix is then placed in the aluminum cup. A convex-faced punch is used to compress the flare composition and flare mix into the closed end of the aluminum cup 24, as shown in FIGS. 1 and 2. After this, the aluminum cover 24 is placed on the shell base 12 so that the cover is interference or friction fit onto the shell base. The shell shot primer 18 is put in place in the shell base 12, as shown in FIG. 1.

At this point, the flare has been assembled and is ready to be fired.

The flare 10 is used by placing it in a flare launcher, for example, of conventional design. An impact is caused which results in the shot shell primer 18 exploding. This explosion creates hot gases in the interior chamber 22 which cause the flare cup 24 and its contents to separate from the shell base 12. In addition, these hot gases ignite the fire mix 32. The ignited fire mix 32 provides a propellent for the flare cup 24 and creates sufficient heat to ignite the flare composition 30.

With the flare cup projectile in the air, the flare composition 30 burns with sufficient intensity to melt the aluminum flare cup 24 and provides a visual signal or indication, similarly to conventional 12-gauge flares.

The present invention provides substantial advantages relative to a conventional flare system. For example, the use of an interference or friction fit between the flare cup 24 and shell base 12 provides a very cost effective and performance effective approach of holding the shell together and, when the shot shell primer is exploded, of reliably and consistently separating the flare cup from the shell base. In addition, the curved surface 34 of the fire mix 32 provides additional surface area, relative to a flat surface, which allows for more effective ignition and propulsion from the fire mix. Also, the convex end surface 28 of the flare cup 24 provides advantageous aerodynamic properties to the projectile, for example, relative to a flat or squared-off end surface of the flare cup.

The combination of features in accordance with the present invention provides substantial performance enhancements. For example, the present flare shell achieves a higher altitude than a conventional 12-gauge flare.

While this invention has been described with respect to various specific examples and embodiments, it is to be understood that the invention is not limited thereto and that it can be variously practiced within the scope of the following claims.

What is claimed is:

1. A flare apparatus comprising:

a shell base having a peripheral outer surface, a first end and an opposing second end which is open, said shell base defining an interior chamber which is open at said second end;

an explosive assembly carried by said shell base at or near said first end and located and adapted, upon activation, to cause gas to pass into said interior chamber;

a flare cover which is interference fit onto said peripheral outer surface of said shell base and extends away from said first end of said shell base, said flare cover defining an interior space and a closed end surface which is convex and is located opposite said first end of said shell base;

a flare composition located in said interior space and effective, when ignited, to provide a visual indication from a projectile including at least a portion of said flare cup; and a fire composition located in said interior space and on or in proximity to said flare composition, said fire composition being effective, when ignited, to propel said flare cover and said fire composition away from said shell base, and to ignite said flare composition.

2. The flare apparatus of claim 1 wherein said shell base is made of polymeric material.

3. The flare apparatus of claim 1 wherein said interior chamber has a truncated "V"-shape in axial cross-section.

4. The flare apparatus of claim 1 wherein said peripheral outer surface of said shell base includes a first portion near said first end and a second portion near said second end, said first portion defining a larger cross-section than said second portion and said flare cover being interference fit onto said second portion of said outer peripheral surface.

5. The flare apparatus of claim 1 wherein said explosive assembly is effective, when activated, to cause said flare cover to separate from said shell base.

6. The flare apparatus of claim 1 wherein said explosive assembly is a shot shell primer.

7. The flare apparatus of claim 1 wherein said flare cup is made of aluminum.

8. The flare apparatus of claim 1 wherein said flare cover includes an outer sidewall configured as a right circular cylinder.

9. The flare apparatus of claim 1 wherein said flare composition includes magnesium.

10. The flare apparatus of claim 1 wherein said fire composition is located on said flare composition.

11. The flare apparatus of claim 1 wherein said fire composition includes a curved surface facing said interior chamber.

12. The flare apparatus of claim 11 wherein said curved surface is convex relative to said interior chamber.

13. The flare apparatus of claim 1 wherein said fire composition includes gun powder and magnesium.

14. A flare apparatus comprising:

a shell base having a peripheral outer surface, a first end and an opposing second end which is open, said shell base defining an interior chamber which is open at said second end;

an explosive assembly carried by the shell base at or near said first end and located and adapted, upon activation, to cause gas to pass into said interior chamber;

a flare cover which is interference fit onto said peripheral outer surface of said shell base and extends away from said first end of said shell base, said flare cover defining an interior space and a closed end surface which is convex and is located opposite said first end of said shell base;

a flare composition comprising magnesium located in said interior space; and a fire composition comprising gun powder and magnesium located on or in proximity to said flare composition, said fire composition including a curved surface facing said interior chamber.

15. The flare apparatus of claim 14 said interior chamber has a truncated "V"-shape in axial cross-section.

16. The flare apparatus of claim 14 wherein said peripheral outer surface of said shell base includes a first portion near said first end and a second portion near said second end, said first portion defining a larger cross-section than said second portion and said flare cover being interference fit onto said second portion of said outer peripheral surface.

17. The flare apparatus of claim 14 wherein said flare cup is made of aluminum.

18. The flare apparatus of claim 14 wherein said fire composition is located on said flare composition and said curved surface of said fire composition is convex relative to said interior chamber.

19. A flare apparatus comprising:

a shell base having a peripheral outer surface, a first end and an opposing second end which is open, said peripheral outer surface including a first portion near said first end and a second portion near said second end, said first portion defining a larger cross-section than said second portion;

said shell base defining an interior chamber which is open at said second end, said interior chamber having a truncated "V"-shape in axial cross-section;

a shot shell primer carried by said shell base at or near said first end;

a flare cover which is interference fit onto said second portion of said peripheral outer surface of said shell base and extends away from said first end of said shell base, said flare cover defining an interior space and a closed end surface which is convex and is located opposite said first end of said shell base;

a flare composition comprising magnesium located in said interior space near said closed end surface; and a fire composition comprising gun powder and magnesium located on said flare composition, said fire composition including a curved surface facing said interior chamber which is convex relative to said interior chamber.

20. The flare apparatus of claim 19 wherein said shell base is made of polymeric material, and said flare case is made of aluminum and includes an outer sidewall configured as a right circular cylinder.

* * * * *